US010960419B2

(12) United States Patent
Tani et al.

(10) Patent No.: US 10,960,419 B2
(45) Date of Patent: Mar. 30, 2021

(54) COATING DEVICE

(71) Applicants: TOYOTA JIDOSHA KABUSHIKI KAISHA, Toyota (JP); Trinity Industrial Corporation, Toyota (JP)

(72) Inventors: Shinji Tani, Miyoshi (JP); Akira Numasato, Nagoya (JP); Atsuo Nabeshima, Okazaki (JP); Takahito Kondo, Nisshin (JP); Yuki Murai, Nagoya (JP); Takao Ueno, Toyota (JP); Katsuhiro Ishikawa, Toyota (JP); Takatoshi Okuta, Toyota (JP); Kota Harada, Toyoake (JP)

(73) Assignees: TOYOTA JIDOSHA KABUSHIKI KAISHA, Toyota (JP); Trinity Industrial Corporation, Toyota (JP)

( * ) Notice: Subject to any disclaimer, the term of this patent is extended or adjusted under 35 U.S.C. 154(b) by 0 days.

(21) Appl. No.: 16/124,800

(22) Filed: Sep. 7, 2018

(65) Prior Publication Data

US 2019/0083994 A1 Mar. 21, 2019

(30) Foreign Application Priority Data

Sep. 19, 2017 (JP) ..... JP2017-179335

(51) Int. Cl.

| | |
|---|---|
| ***B05B 5/04*** | (2006.01) |
| ***B05B 5/053*** | (2006.01) |
| ***B05C 5/02*** | (2006.01) |

(52) U.S. Cl.

CPC ..... *B05B 5/0403* (2013.01); *B05B 5/0407* (2013.01); *B05B 5/0411* (2013.01); *B05B 5/053* (2013.01); *B05C 5/02* (2013.01)

(58) Field of Classification Search

None

See application file for complete search history.

(56) References Cited

U.S. PATENT DOCUMENTS 2,728,606 A * 12/1955 Juvinall ..... B05B 5/0403 239/224
2,754,226 A * 7/1956 Juvinall ..... B05B 3/1078 427/484
2,780,565 A * 2/1957 Juvinall ..... B05B 5/04 427/480

(Continued)

FOREIGN PATENT DOCUMENTS

JP 2009-028631 A 2/2009
JP 2017-042749 A 3/2017

*Primary Examiner* — Jethro M. Pence
(74) *Attorney, Agent, or Firm* — Sughrue Mion, PLLC

(57) ABSTRACT

A coating device is equipped with a rotary head, a drive unit, and an electric power supply unit. The rotary head is configured to be supplied with a coating material. The rotary head includes a diffusion surface that is configured such that the coating material is diffused toward an outer edge portion of the diffusion surface by a centrifugal force, and a plurality of groove portions that are included in the outer edge portion. The rotary head is configured to discharge a thread-like coating material from the groove portions. Also, the coating device is configured such that a diameter of the threadlike coating material is set equal to or larger than 0.03 mm and equal to or smaller than 0.1 mm and that the threadlike coating material is electrostatically atomized.

9 Claims, 3 Drawing Sheets

(56) References Cited

U.S. PATENT DOCUMENTS

| | | | | |
|---|---|---|---|---|
| 2,794,751 | A * | 6/1957 | Javinall | B05B 5/14 427/482 |
| 2010/0155504 | A1 | 6/2010 | Yamasaki et al. | |
| 2017/0056901 | A1 | 3/2017 | Tani et al. | |

* cited by examiner

COATING DEVICE

INCORPORATION BY REFERENCE

The disclosure of Japanese Patent Application No. 2017-179335 filed on Sep. 19, 2017 including the specification, drawings and abstract is incorporated herein by reference in its entirety.

BACKGROUND

1. Technical Field

The disclosure relates to a coating device.

2. Description of Related Art

Conventionally, there is known a coating device that atomizes (pulverizes) a coating material discharged from a bell cup by blowing shaping air onto the coating material. In this coating device, an accompanying flow of shaping air is reflected by an object to be coated, and coating material particles (the atomized coating material) are kicked up. Therefore, there is an inconvenience such as a decrease in coating efficiency.

Thus, there is proposed a coating device that does not use shaping air (see Japanese Patent Application Publication No. 2017-42749 (JP 2017-42749 A)). The coating device of JP 2017-42749 A is configured to discharge a threadlike coating material from a rotary head, and electrostatically atomize the threadlike coating material. Thus, the coating material can be atomized without using shaping air, so the coating efficiency can be enhanced.

SUMMARY

However, the above-mentioned JP 2017-42749 A does not consider the threadlike coating material discharged from the rotary head, and has room for improvement in this respect.

The disclosure provides a coating device that can electrostatically atomize, in an appropriate manner, a threadlike coating material discharged from a rotary head.

A coating device according to the disclosure is equipped with a rotary head, a drive unit, and an electric power supply unit. The rotary head is configured to be supplied with a coating material. The drive unit is configured to rotate the rotary head. The electric power supply unit is configured to apply a voltage to the rotary head so as to form an electric field between the rotary head and a grounded object to be coated. The rotary head includes a diffusion surface that is configured to diffuse the coating material toward an outer edge portion of the diffusion surface by a centrifugal force, and a plurality of groove portions that are included in the outer edge portion. The rotary head is configured to discharge a threadlike coating material from the groove portions. Also, the coating device is configured such that a diameter of the threadlike coating material is set equal to or larger than 0.03 mm and equal to or smaller than 0.1 mm and that the threadlike coating material is electrostatically atomized.

Due to this configuration, the threadlike coating material can be electrostatically atomized in an appropriate manner by making the dimension of the threadlike coating material suitable for electrostatic atomization.

In the aforementioned coating device, the length of the threadlike coating material may be set equal to or longer than 2 mm and equal to or shorter than 46 mm.

Due to this configuration, the threadlike coating material can be electrostatically atomized in a more appropriate manner by making the dimension of the threadlike coating material suitable for electrostatic atomization.

In the aforementioned coating device, each of the groove portions may be configured to have a cross-sectional area that is larger than a maximum value of a cross-sectional area of the threadlike coating material.

Due to this configuration, the coating material can be restrained from overflowing from the groove portions at the outer edge portion of the rotary head even in the case where the cross-sectional area of the threadlike coating material is maximized.

In the aforementioned coating device, the groove portions may extend in a radial direction of the rotary head, and each of the groove portions may be configured to reach an end portion of the rotary head.

Due to this configuration, the coating material can be divided into pieces by the groove portions to the end portion of the rotary head, so the pieces of the discharged threadlike coating material can be restrained from being joined together.

In the aforementioned coating device, the diameter of the rotary head may be 20 to 50 mm.

In the aforementioned coating device, each of the groove portions may have a V-shaped or U-shaped cross-section.

In the aforementioned coating device, each of the groove portions may be configured to have a cross-sectional area that is larger than 0.0025n $mm^2$.

In the aforementioned coating device, a dimension of the threadlike coating material may be set based on a flow rate of the coating material supplied to the rotary head and a rotational speed of the rotary head.

In the aforementioned coating device, the rotational speed of the rotary head may be 10000 to 30000 rpm when the coating material is discharged.

In the aforementioned coating device, the flow rate of the coating material supplied to the rotary head may be 10 to 300 cc/min.

The coating device according to the disclosure can electrostatically atomize, in an appropriate manner, the threadlike coating material discharged from the rotary head.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

One of the embodiments of the disclosure will be described hereinafter based on the drawings.

First of all, a coating device 100 according to the embodiment of the disclosure will be described with reference to FIGS. 1 to 5.

Figure 1:
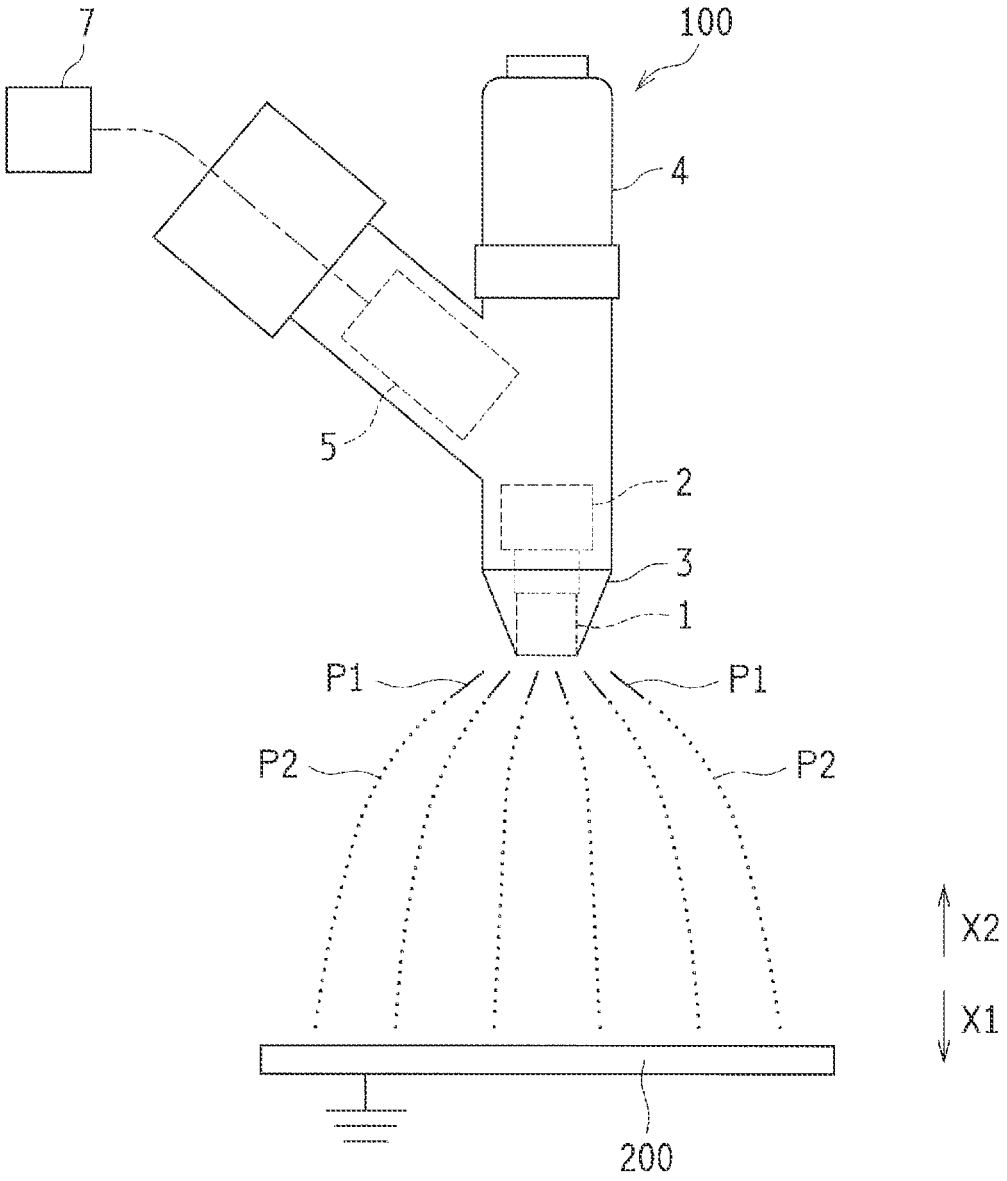
FIG. 1 is a schematic configuration view for illustrating a coating device according to one of the embodiments.

The coating device 100 is configured to form coating material particles (an atomized coating material) P2 and apply them to an object to be coated 200 by discharging a threadlike coating material P1 from a rotary head 1 and electrostatically atomizing the threadlike coating material P1. Incidentally, the object to be coated 200 is, for example, a body of a vehicle. As shown in FIG. 1, this coating device 100 is equipped with the rotary head 1, an air motor 2, a cap 3, a coating material cartridge 4, and a voltage generator 5.

Figure 2:
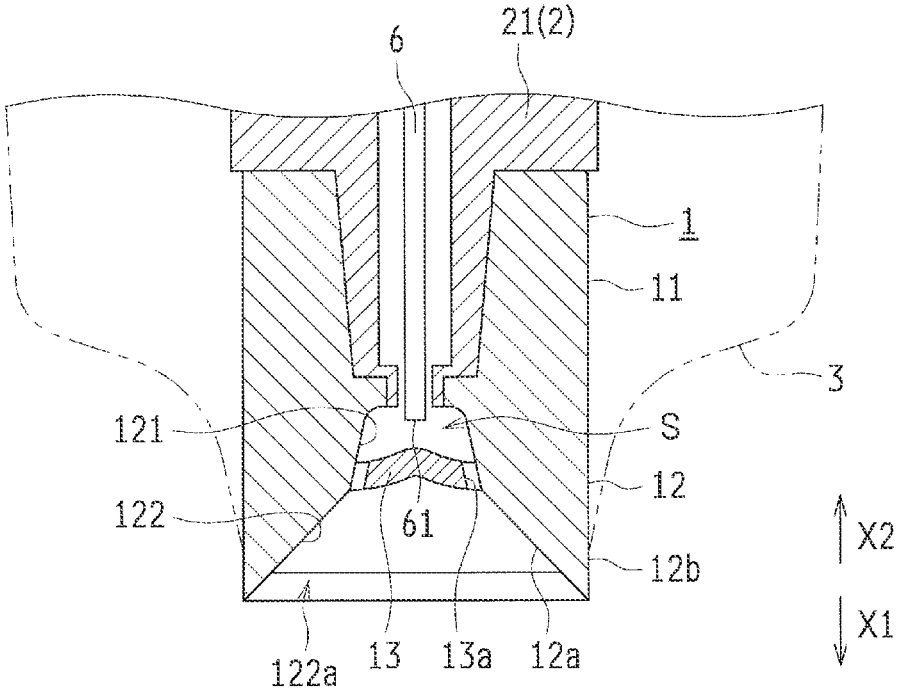
FIG. 2 is a cross-sectional view showing a rotary head of the coating device of FIG. 1.
Figure 3:
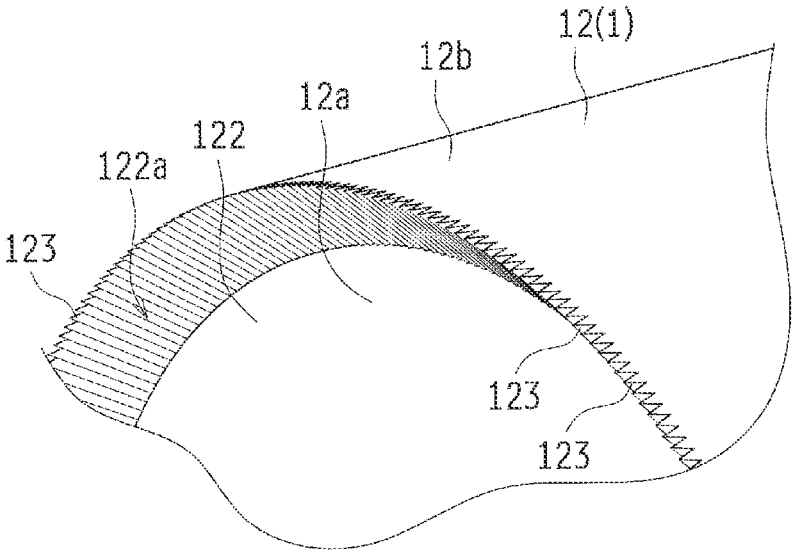
FIG. 3 is a perspective view showing a tip of the rotary head of FIG. 2.
Figure 4:
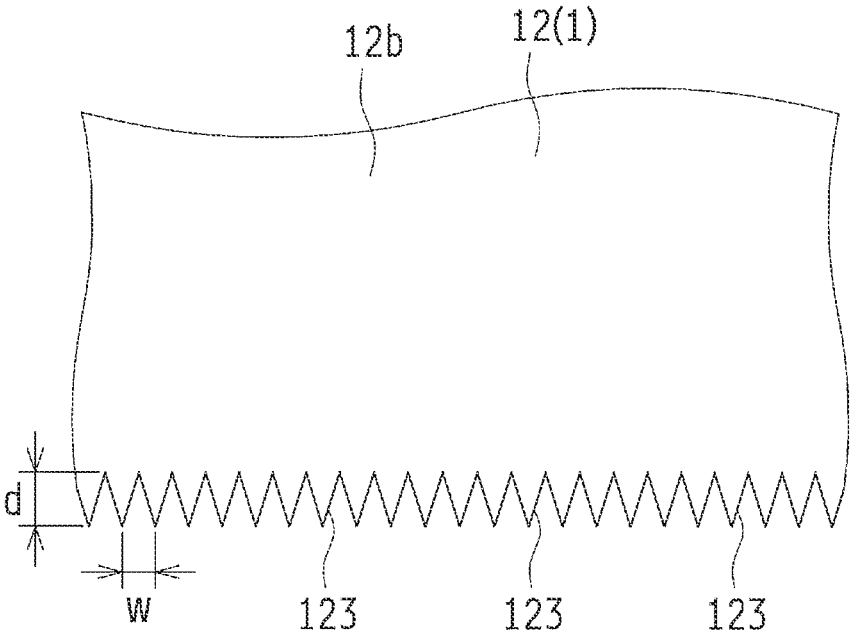
FIG. 4 is a radially outward view of the tip of the rotary head of FIG. 3.

The rotary head 1 is configured to be supplied with the liquid coating material and discharge the coating material through a centrifugal force. As shown in FIG. 2, this rotary head 1 is cylindrically formed, and includes an attachment portion 11 that is arranged at a base end side (an X2-direction side) and a head portion 12 that is arranged on a leading end side (an X1-direction side). Incidentally, the diameter of the rotary head 1 is, for example, 20 to 50 mm.

A rotary shaft 21 of the air motor 2 is attached to an inner peripheral surface of the attachment portion 11. The rotary shaft 21 is hollowly formed and has a coating material supply pipe 6 arranged therein. The coating material supply pipe 6 is provided to supply the head portion 12 with the coating material stored in the coating material cartridge 4. A nozzle (not shown) is formed at a leading end 61 of the coating material supply pipe 6.

The head portion 12 has an inner surface 12*a* and an outer surface 12*b*, and is formed such that the inner surface 12*a* is increased in diameter toward the leading end side thereof. A concave portion 121, which is circular as viewed in an axial direction, is formed in the inner surface 12*a* at a center thereof. A hub 13 is provided in such a manner as to close up the concave portion 121. Therefore, a coating material space S is defined by the concave portion 121 and the hub 13, and the leading end 61 of the coating material supply pipe 6 is arranged in such a manner as to face the coating material space S. An outflow hole 13*a* for causing the coating material to flow out from the coating material space S is formed at an outer edge portion of the hub 13.

Moreover, the inner surface 12*a*, which is located radially outward of the outflow hole 13*a*, functions as a diffusion surface 122 on which the coating material is diffused by a centrifugal force. This diffusion surface 122 is formed in such a manner as to be increased in diameter toward a leading end side thereof. Besides, a plurality of groove portions 123 (see FIGS. 3 and 4) are formed at an outer edge portion 122*a* of the diffusion surface 122. Incidentally, in FIG. 2, the groove portions 123 are not shown in consideration of visibility.

The groove portions 123 are provided to discharge the coating material in a threadlike manner. The groove portions 123 are formed in such a manner as to extend in a radial direction, and are provided in a circumferential direction. Incidentally, the circumferential direction is a rotational direction of the rotary head 1, and the radial direction is a direction perpendicular to an axial direction of the rotary head 1. Besides, the number of groove portions 123 is, for example, 600 to 1200. Each of these groove portions 123 is formed with a V-shaped (triangular) cross-section, and is formed in such a manner as to reach an end portion of the rotary head 1. Therefore, the cross-section of each of the groove portions 123 emerges on the outer surface 12*b*, and the leading end of the rotary head 1 is convexo-concave as viewed from the outer surface 12*b* side.

The air motor 2 (see FIG. 1) is provided to rotate the rotary head 1. This air motor 2 has the rotatable rotary shaft 21. The rotary shaft 21 is coupled to the rotary head 1. Incidentally, the air motor 2 is an example of "the drive unit" according to the disclosure.

The cap 3 is configured to cover an outer peripheral surface of the rotary head 1, and is formed like a taper in such a manner as to decrease in diameter toward a leading end side thereof. This cap 3 is annularly formed as viewed in the axial direction of the rotary head 1, and has the rotary head 1 arranged therein. That is, the cap 3 is provided in such a manner as to surround a periphery of the rotary head 1.

As shown in FIG. 1, the coating material cartridge 4 is removably provided, and stores the coating material therein. The coating material stored in the coating material cartridge 4 can be supplied to the rotary head 1 via the coating material supply pipe 6 (see FIG. 2).

The voltage generator 5 is configured to generate a negative high voltage and apply the negative high voltage to the rotary head 1. This voltage generator 5 is provided to form an electric field between the grounded object to be coated 200 and the rotary head 1. Due to the electric field between the object to be coated 200 and the rotary head 1, the threadlike coating material P1 is electrostatically atomized, and the charged coating material particles P2 are applied to the object to be coated 200. Besides, a voltage control unit 7 is connected to the voltage generator 5. The voltage control unit 7 can control the output voltage of the voltage generator 5. The voltage control unit 7 is provided to restrain the intensity of the electric field between the rotary head 1 and the object to be coated 200 from fluctuating, by controlling the voltage applied to the rotary head 1. Incidentally, the voltage generator 5 is an example of "the electric power supply unit" according to the disclosure.

This coating device 100 is configured to discharge the threadlike coating material P1 from the groove portions 123 (see FIG. 3) of the rotary head 1, and atomize (pulverize) the threadlike coating material P1 through an electrostatic force. That is, since the coating device 100 is not provided with an air discharge unit that discharges shaping air, the coating material particles P2 are formed regardless of shaping air. Therefore, an accompanying flow of the shaping air reflected by the object to be coated does not kick up the coating material, and the coating efficiency can be enhanced.

Figure 5:
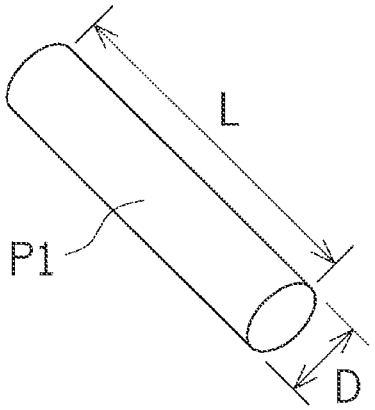
FIG. 5 is a schematic view showing a threadlike coating material discharged from the coating device of FIG. 1.

It should be noted herein that the threadlike coating material P1 discharged from the rotary head 1 has a diameter D set to 0.03 to 0.1 mm as shown in FIG. 5, in the present embodiment of the disclosure. That is, the diameter D of the threadlike coating material P1 is set equal to or larger than 0.03 mm and equal to or smaller than 0.1 mm. In the present embodiment of the disclosure, the threadlike coating material P1 is made finer than in the conventional coating device that carries out atomization through the use of shaping air. Besides, the threadlike coating material P1 has a length L set to 2 to 46 mm. That is, the length L of the threadlike coating material P1 is set equal to or larger than 2 mm and equal to or smaller than 46 mm. Incidentally, the length L is a length in a direction in which the threadlike coating material P1 extends. Besides, the numerical ranges of the diameter D and the length L are specified based on a result of an experiment conducted by the inventor, or the like.

Moreover, each of the groove portions 123 is configured to have a cross-section that is larger than a maximum value of a cross-section of the threadlike coating material P1. In concrete terms, each of the groove portions 123 is configured to have a cross-section that is larger than 0.0025n $mm^2$. Thus, even in the case where the cross-sectional area of the threadlike coating material P1 is maximized, the coating material can be restrained from overflowing from the groove portions 123 at the outer edge portion 122*a* (see FIG. 3) of the rotary head 1. That is, the threadlike coating material P1 discharged from a predetermined one of the groove portions 123 and the threadlike coating material P1 discharged from the groove portion 123 in the vicinity of the predetermined one of the groove portions 123 can be restrained from being joined together. In the present embodiment of the disclosure, the cross-section of each of the groove portions 123 is formed in the shape of V (triangularly), so a relationship according to an expression (1) shown below is established.

$$wd/2>\pi(0.05)^2 \quad (1)$$

Incidentally, in the expression (1), w denotes the width of each of the groove portions 123, d denotes the depth of each of the groove portions 123, and π denotes the circular constant. The unit of w and d is mm.

—Operation Example at Time of Coating—

Next, an operation example of the coating device 100 will be described with reference to FIGS. 1 to 5.

First of all, at the time of coating, a negative high voltage is applied to the rotary head 1 by the voltage generator 5, and the object to be coated 200 is grounded, as shown in FIG. 1. Thus, an electric field is formed between the rotary head 1 and the object to be coated 200. Incidentally, the negative high voltage is, for example, −30000 to −70000 V. Then, the rotary head 1 is rotated at high speed by the air motor 2. Incidentally, the rotational speed (the number of revolutions per minute) of the rotary head 1 is, for example, 10000 to 30000 rpm.

Subsequently, the liquid coating material is discharged from the nozzle of the coating material supply pipe 6, and is supplied to the coating material space S, as shown in FIG. 2. Incidentally, the flow rate of the coating material discharged from the nozzle is, for example, 10 to 300 cc/min. The coating material supplied to the coating material space S is caused to flow out from the outflow hole 13*a* by a centrifugal force.

Then, the coating material that has flowed out from the outflow hole 13*a* flows radially outward along the diffusion surface 122 due to the centrifugal force. The coating material that flows along the diffusion surface 122 becomes membranal, reaches the outer edge portion 122*a*, and is supplied to the groove portions 123 (see FIGS. 3 and 4). The coating material has not overflowed from the groove portions 123 at this outer edge portion 122*a*, and the coating material in each of the groove portions 123 is separated from the coating material in each of the groove portions 123 adjacent thereto. That is, the membranal coating material is divided into pieces in the circumferential direction by the groove portions 123. Incidentally, the membrane thickness of the membranal coating material is homogenized due to the centrifugal force, and the coating material is substantially homogeneously supplied to the respective groove portions 123. The coating material passing through the groove portions 123 becomes threadlike, and is discharged from the end portion of the rotary head 1 (the groove portions 123 emerging on the outer surface 12*b*).

The threadlike coating material P1 discharged from the rotary head 1 is atomized by an electrostatic force. It should be noted herein that the diameter D of the threadlike coating material P1 (see FIG. 5) is set to 0.03 to 0.1 mm, and that the length L thereof is set to 2 to 46 mm. Incidentally, the dimension of the threadlike coating material P1 can be adjusted based on the flow rate of the coating material, the rotational speed of the rotary head 1, or the like. In this manner, the threadlike coating material P1 can be electrostatically atomized in an appropriate manner by microfabricating the threadlike coating material P1 and reducing the volume (surface area) thereof. Incidentally, the particle diameter of the coating material particles P2 (see FIG. 1) formed through electrostatic atomization is, for example, a Sauter average particle size of 20 to 30 μm. Then, the coating material particles P2 are negatively charged, and are attracted toward the grounded object to be coated 200. Therefore, the coating material particles P2 are applied to the object to be coated 200, and a coating film (not shown) is formed on a surface of the object to be coated 200.

Besides, the voltage applied to the rotary head 1 by the voltage generator 5 is controlled by the voltage control unit 7. In concrete terms, the voltage applied to the rotary head 1 by the voltage generator 5 is adjusted by the voltage control unit 7 such that the current (discharge current) flowing between the rotary head 1 and the object to be coated 200 becomes constant. Therefore, when the distance between the rotary head 1 and the object to be coated 200 becomes short and the discharge current becomes large, the voltage applied to the rotary head 1 is lowered in such a manner as to counterbalance the change in discharge current. On the other hand, when the distance between the rotary head 1 and the object to be coated 200 becomes long and the discharge current becomes small, the voltage applied to the rotary head 1 is raised in such a manner as to counterbalance the change in discharge current. Thus, the intensity of the electric field between the rotary head 1 and the object to be coated 200 can be restrained from fluctuating.

Effect

In the present embodiment of the disclosure, as described above, the threadlike coating material P1 is made finer than in the conventional coating device that carries out atomization through the use of shaping air, by discharging the threadlike coating material P1 from the rotary head 1 and setting the diameter D of the threadlike coating material P1 to 0.03 to 0.1 mm. Therefore, the threadlike coating material P1 can be electrostatically atomized in an appropriate manner. Accordingly, the coating material can be atomized without using shaping air, so the coating efficiency can be enhanced.

Besides, in the present embodiment of the disclosure, the volume (surface area) of the threadlike coating material P1 can be made suitable for electrostatic atomization, by setting the length L of the threadlike coating material P1 to 2 to 46 mm. Therefore, the threadlike coating material P1 can be electrostatically atomized in a more appropriate manner.

Besides, in the present embodiment of the disclosure, even in the case where the cross-sectional area of the threadlike coating material P1 is maximized (in the case where the diameter D is 0.1 mm), the coating material can be restrained from overflowing from the groove portions 123 at the outer edge portion 122*a* of the rotary head 1, by making the cross-sectional area of each of the groove portions 123 larger than the maximum value of the cross-sectional area of the coating material P1. Thus, the membranal coating material flowing along the diffusion surface 122 is divided into pieces by the groove portions 123. Therefore, the threadlike coating material P1 can be discharged from the groove portions 123 of the rotary head 1. That is, the threadlike coating material P1 discharged from a predetermined one of the groove portions 123 and the threadlike coating material P1 discharged from the groove portion 123 in the vicinity of the predetermined one of the groove portions 123 can be restrained from being joined together.

Besides, in the present embodiment of the disclosure, the coating material can be divided into pieces by the groove portions 123 until the coating material reaches the end portion of the rotary head 1, by forming the groove portions 123 such that the groove portions 123 reach the end portion of the rotary head 1. Therefore, the pieces of the discharged threadlike coating material P1 can be restrained from being joined together.

Besides, in the present embodiment of the disclosure, the intensity of the electric field between the rotary head 1 and the object to be coated 200 can be restrained from fluctuating, by controlling the output voltage of the voltage generator 5 through the use of the voltage control unit 7 such that the discharge current becomes constant. Therefore, the performance of atomization through the electrostatic force can be stabilized.

Besides, in the present embodiment of the disclosure, the turbulence of air can be restrained from occurring around the rotary head 1 as a result of rotation of the rotary head 1, unlike the case where the rotary head is in the shape of a cup, by cylindrically forming the rotary head 1 and providing the rotary head 1 with the tapered cap 3 that decreases in diameter toward the leading end side thereof.

OTHER EMBODIMENTS

Incidentally, the embodiment of the disclosure disclosed herein is exemplary in every respect, and does not constitute a ground for limited interpretation. Accordingly, the technical scope of the disclosure is not interpreted only by the aforementioned embodiment of the disclosure, but is defined based on what is described in the claims. Besides, the technical scope of the disclosure encompasses all the modifications that are equivalent in meaning and scope to the claims.

For example, in the present embodiment of the disclosure, the coating material may be a water-borne coating material or a solvent coating material.

Besides, the present embodiment of the disclosure presents an example in which each of the groove portions 123 has a V-shaped cross-section, but the disclosure is not limited thereto. The cross-section of each of the groove portions may assume other shapes. For example, each of the groove portions may have a U-shaped cross-section or the like.

Besides, in the present embodiment of the disclosure, the depth d and width w of each of the groove portions 123 may be constant in the radial direction (the direction in which each of the groove portions 123 extends). That is, the cross-sectional area of each of the groove portions 123 may be constant in the radial direction. Besides, the depth d and width w of each of the groove portions 123 may be gradually increased from the inside toward the outside in the radial direction. That is, the cross-sectional area of each of the groove portions 123 may be gradually increased from the inside toward the outside in the radial direction. In this case, each of the groove portions 123 may be configured such that the cross-sectional area of a radially outward end portion thereof (the largest cross-sectional area thereof) is larger than the maximum value of the cross-sectional area of the threadlike coating material P1.

The disclosure can be utilized for a coating device that is equipped with a rotary head that is configured to be supplied with a coating material, a drive unit that is configured to rotate the rotary head, and an electric power supply unit that is configured to apply a voltage to the rotary head so as to form an electric field between the rotary head and a grounded object to be coated.

What is claimed is:

1. A coating device comprising:

a rotary head that is configured to be supplied with a coating material;

a motor that is configured to rotate the rotary head; and an voltage generator that is configured to apply a voltage to the rotary head so as to form an electric field between the rotary head and a grounded object to be coated, wherein the rotary head includes a diffusion surface that is configured such that the coating material is diffused toward an outer edge portion of the diffusion surface by a centrifugal force, and a plurality of groove portions that are formed on the outer edge portion of the diffusion surface, the diffusion surface being an inner surface facing a rotation axis of the rotary head, the rotary head is configured to discharge a threadlike coating material from the groove portions, a diameter of the threadlike coating material is set equal to or larger than 0.03 mm and equal to or smaller than 0.1 mm, the threadlike coating material is configured to be electrostatically atomized, and the rotary head is configured to discharge the threadlike coating material that has a length that is set equal to or longer than 2 mm and equal to or shorter than 46 mm, wherein each of the groove portions has a V-shaped cross-section in an axial direction of the rotary head, and wherein the groove portions extend along an entire length of the diffusion surface.

2. The coating device according to claim 1, wherein each of the groove portions is configured to have a cross-sectional area that is larger than a maximum value of a cross-sectional area of the threadlike coating material.

3. The coating device according to claim 1, wherein the groove portions extend in a radial direction of the rotary head, and each of the groove portions is configured to reach an end portion of the rotary head.

4. The coating device according to claim 1, wherein the rotary head has a diameter of 20 to 50 mm.

5. The coating device according to claim 1, wherein each of the groove portions is configured to have a cross-sectional area that is larger than $0.00257\ \pi\ mm^2$.

6. The coating device according to claim 1, wherein a dimension of the threadlike coating material is set based on a flow rate of the coating material supplied to the rotary head and a rotational speed of the rotary head.

7. The coating device according to claim 6, wherein the rotational speed of the rotary head is 10000 to 30000 rpm when the coating material is discharged.

8. The coating device according to claim 6, further comprising a coating material supply pipe that is configured to supply the coating material to the rotary head at the flow rate of 10 to 300 cc/min.

9. The coating device according to claim 1, wherein the outer edge portion of the diffusion surface is located at an outermost diffusion surface in a radial direction.

* * * * *